US005484224A

United States Patent [19]

Lynch

[11] Patent Number: 5,484,224

[45] Date of Patent: Jan. 16, 1996

[54] METHOD OF RESURFACING AN ASPHALT SURFACE

[76] Inventor: Edward T. Lynch, P.O. Box 427, Chino, Calif. 91708

[21] Appl. No.: 285,704

[22] Filed: Aug. 4, 1994

[51] Int. Cl.[6] ..... E01C 7/06

[52] U.S. Cl. ..... 404/77

[58] Field of Search ..... 404/75, 77

[56] References Cited

U.S. PATENT DOCUMENTS 3,843,274 10/1974 Gutman ..... 404/91
4,124,325 11/1978 Cutler ..... 404/75
4,335,975 6/1982 Schoelkopf ..... 404/77
4,793,730 12/1988 Butch ..... 404/77
5,405,213 4/1995 O'Connor ..... 404/77

*Primary Examiner*—William P. Neuder
*Attorney, Agent, or Firm*—Jack C. Munro

[57] ABSTRACT

The method of resurfacing an asphalt surface which comprisies heating of the surface, scarifying the surface creating a layer of loose aggregate material, adding an amount of additional virgin asphalt in the amount of 10% to 30% by weight of the loose aggregate material, evenly applying a quantity of heated light oil to the loose aggregate material, thoroughly mixing of the loose aggregate material and the oil, screeding the loose aggregate material forming a level surface and then rolling the level surface achieving compaction plus cementing of the loose aggregate material.

6 Claims, 1 Drawing Sheet

METHOD OF RESURFACING AN ASPHALT SURFACE

BACKGROUND OF THE INVENTION

1) Field of the Invention

The field of this invention relates generally to resurfacing methods and more particularly to a new and improved method of recycling an asphalt surface such as a roadway or pavement.

2) Description of the Prior Art

Asphalt is widely used in the construction of highways and parking areas where large areas need to be covered with a relatively hard, flat, weather-resistant surface suitable for vehicular travel. With prolonged usage these asphalt surfaces develop cracks which permit the seepage of water therethrough to undermine the sand and rock subbase. Asphalt pavement includes a light oil that functions as a binder with the aggregate contained within the asphalt. The sun, as well as the amount of vehicular travel, causes this light oil to vaporize thereby causing the asphalt roadway to deteriorate. This deterioration of the asphalt surface necessitates reconditioning of that surface.

In the past it has been a common practice to recondition a worn asphalt surface by a hot application of a new mat of asphaltic material over the existing surface to form a new flat surface. This application of new material raises the general level of the asphalt surface by 1 inch to 1½ inches. The problem with such an application of new material is that after a few years, and the surface has been reconditioned four or five times, the new surface is 5 inches to 9 inches higher than the old original surface. This raised surface level can be an especially serious problem, especially now where the roadway is at a higher level than the adjoining gutters or sidewalks. Each time a roadway is resurfaced by using overlay procedures reduces overhead room of underpasses. Where overlaying is done across bridges, each overlay applied to the bridge adds to the dead weight that the bridges must carry thereby diminishing the amount of vehicular weight that the bridge is able to carry with safety.

A more recent practice has been to recondition old asphalt surfaces by breaking up of the existing asphalt aggregate material, picking up the material for reconditioning, heating and then reapplying the heated reconditioned material as a new surface. The pavement is heated, scarified to a certain depth by a scarifying tool producing loose aggregate material. This loose aggregate material is then picked up, placed within a mixing vat where it is pulverized, combined with a light oil and then reapplied to the asphalt material.

This past method of recycling of the old asphalt has a disadvantage that it requires picking up of the old asphalt, moving it to a mixing location and then bringing it back and reapplying it to the roadway. It would substantially diminish the cost of resurfacing an asphalt roadway or pavement if this recycling procedure did not require the physical picking up of the loose aggregate material and transporting such to a mixer and then retransporting it back to be applied to the asphalt surface.

SUMMARY OF THE INVENTION

The primary objective of the present invention is to resurface a deteriorated asphalt surface (roadway or pavement) by utilizing the existing material of the surface and accomplishing the resurfacing directly on the surface, eliminating the need for transporting of the material of the surface during the regeneration process.

Another objective of the present invention is to utilize an asphaltic pavement resurfacing process which can be accomplished at a substantially lower cost than previously known for resurfacing processes.

Another objective of the present invention is to provide a surface asphalt recycling process which maintains the established surface configuration such as the common slightly domed configuration for water drainage.

The method of resurfacing an asphalt surface of the present invention utilizes applying sufficient heat to a section of asphalt surface to raise the temperature of the surface to between 220° F. and 375° F. This section of the surface is then scarified to an depth of about 1 inch to 1½ inches producing a layer of loose aggregate material. A small amount, generally within the range of 10% to 30% by weight of the loose aggregate material, of additional virgin asphalt is applied. To this section of the surface there is now applied a quantity of light oil which has been heated to about 240° F. The amount of light oil that is applied is to be within the range of 0.09 gallons per square yard of surface to 0.12 gallons per square yard. The loose aggregate material, oil and virgin asphalt are thoroughly and evenly mixed, screeded and then rolled achieving compaction and cementing.

DETAILED DESCRIPTION OF THE PREFERRED EMBODIMENT

Figure 1:
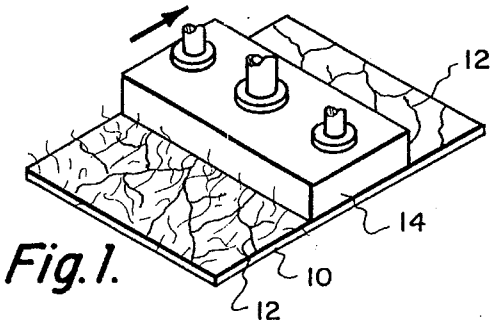
FIGS. 1 to 9 generally depict the sequence of operations of the method of the present invention that are required to resurface a section of asphalt surface with little or no consideration being given to the actual apparatus that would be employed.
Figure 2:
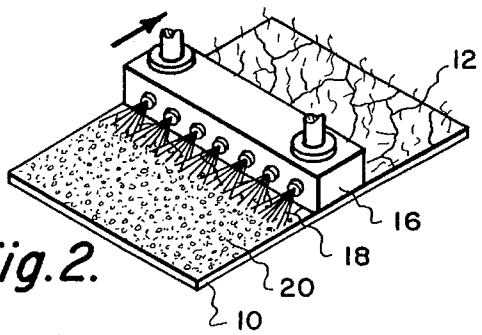

Referring particularly to FIG. 1 there is shown a deteriorated section of asphalt surface 10 which includes a plurality of cracks 12. A heater 14 is placed over the section of the pavement 10 with generally the size of the heater 14 being fourteen feet by eighteen feet. Propane gas is to be emitted and ignited within the heater 14 producing an exceedingly high heat environment. This heater 14 is slowly moved across the surface 10 and, after the heater has passed, the section of the surface directly behind the heater 14 will be within the range of 240° F. to 375° F. The now heated surface 10 has a scarifier 16 conducted thereover. The scarifier 16 includes a plurality of sharp rakes 18 each of which is independently mounted on the scarifier 16. This independent mounting will permit the rakes 18 to pass over any kind of solid object such as a manhole. The rakes 18 will dig into the surface 10 to the depth of about 1 to 1½ inches with this depth being selectable. The result is the upper surface of the surface 10 is formed into a layer of loose aggregate 20.

Figure 3:
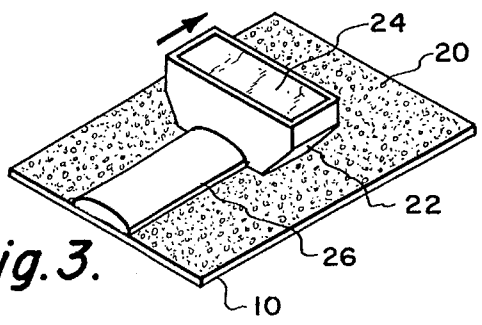

Referring now to FIG. 3, a hopper 22 is passed over the surface 10 with a quantity of virgin asphalt 24 being contained within the hopper 22. This virgin asphalt 24 is dispensed from the hopper 22 by means of an auger producing a windrow 26 of new virgin asphalt on the surface 10. The virgin asphalt 24 will be heated generally in the range of 22020 F. to 240° F.

Figure 4:
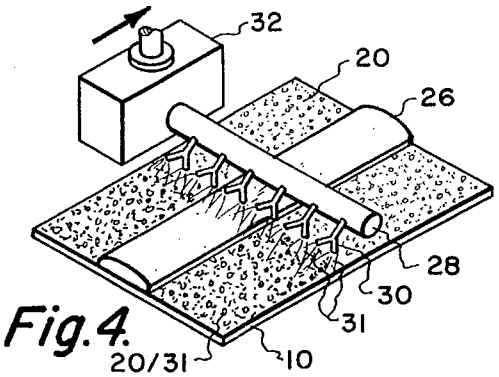

Referring particularly to FIG. 4 the section of surface 10 which has the loose aggregate 20 and the windrow 26 has conducted thereover a pipe 28 from which extends a plurality of spray nozzles 30. The pipe 28 connects to reservoir 32. Contained within the reservoir 32 is a quantity of an oil 31. This oil 31 is petroleum based and it is what is frequently termed a "light oil". The specification for this light oil 31 is referred to as a RA-5, light grade. This oil 31 is made up of alphaltenes and malthenes. In such an oil the greater the alphaltenes the more viscous the oil and logically the less the alphaltenes, the less viscous or lighter the oil. The oil 31 that is used in conjunction with this invention contains about 1% to 4% of alphaltenes with malthenes being in the range of 96% to 99%. During service of a roadway or pavement, the alphaltenes increase in proportion because the malthenes eventually vaporize. This results in the asphalt pavement becoming progressively harder and more brittle producing the cracks which are referred to as deterioration of the surface. Putting back into the loose aggregate material 20 this light oil causes the asphalt loose aggregate material 20 to be as good as new.

Figure 5:
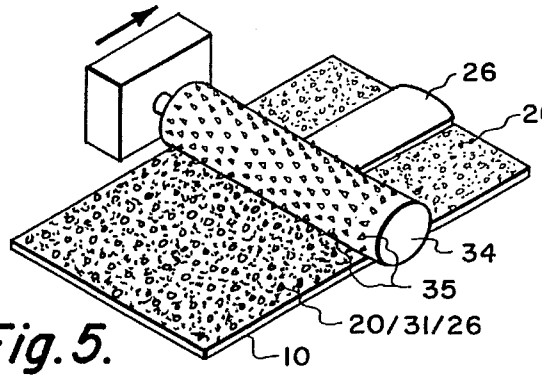

Referring particularly to FIG. 5, a roller 34 is conducted over the surface section 10 of the surface. This roller 34 includes a mass of cutting blades 35. These cutting blades 35 more finely pulverize the loose aggregate material 20 and windrow 26 that contains oil 31 and distribute the virgin material of windrow 26 across the width of the pavement section 10.

Figure 6:
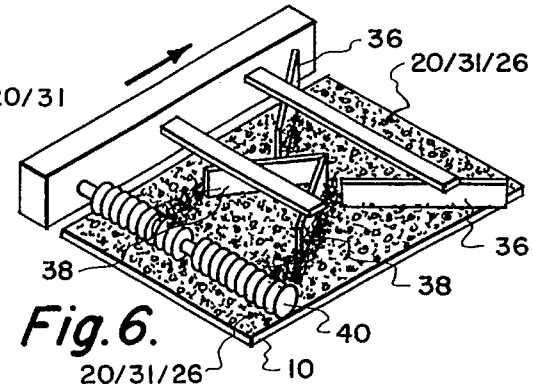

Referring particularly to FIG. 6, conducted across the section 10 are a pair of curved blades 36 which pick up the loose aggregate material 20/31/26, mixing such and dispensing of the loose aggregate material 20/31/26 onto a V-shaped section of another pair of curved blades 38. The loose aggregate material 20/31/26 is continuing to be mixed when conducting past the blades 38 and then is deposited in conjunction with a split auger 40. It is the function of the auger 40 to evenly distribute the loose aggregate material 20 that has now been combined with the virgin asphalt material 26 and the oil 31.

Figure 7:
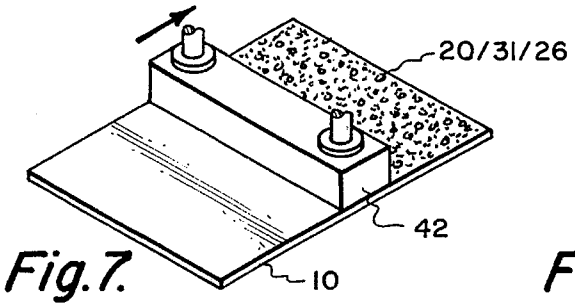
Figure 8:
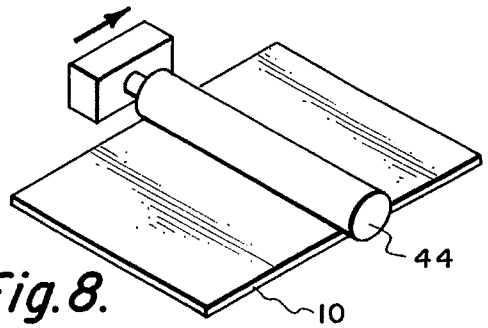
Figure 9:
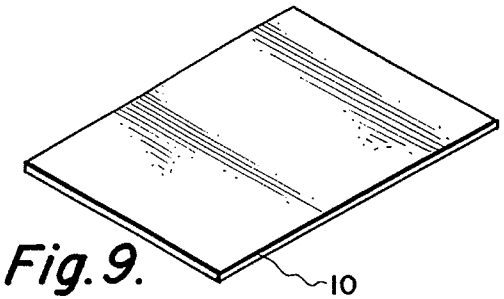

Referring now to FIG. 7 a screed 42 is passed over the section 10 producing a smooth level surface of the loose aggregate material 20/31/26. Conducted across this smooth level surface of the section 10 is a compacting roller 44 which is shown in FIG. 8. Actual compaction will occur by generally at least two different types of compaction roller vehicles that are driven across the section 10. After compaction by the roller 44, there is produced the resurfaced asphalt surface within the section 10 shown in FIG. 9.

The equipment used for the heater 14 is designed to comply with the requirements of the local Bureau of Air Pollution Control where the heater 14 is being used. The heater 14 shall have a minimum rating of 15 million BTUs output per hour. The heater 14, although designed to use propane, is also capable of using butane. The combustion chambers shall be insulated and totally enclosed to provide sufficient heat to the pavement 10 in order to sufficiently raise the temperature of the section 10 of the surface. Scarifier 16 may also include a mechanically driven milling drum utilizing carbide cutting bits similar to the roller 34. The width of the scarified pavement shall not be greater than the width of the heater 14. The milling drums that are used, such as roller 34, are normally hydraulically controlled to vary the depth of cut within section 10.

The section 10 shall have a laboratory analysis performed to determine the amount of oil 31 that is to be applied. If the section 10 has only slightly deteriorated, then generally an amount of about 0.09 gallons per square yard of oil will be applied. If the pavement 10 is exceedingly brittle and well deteriorated, approximately 0.12 gallons per square yard of oil will be applied. This is assuming the preselected depth for scarifying of the surface is about one inch. If the preselected depth is increased to about 1½ inches, an appropriate proportional increase in the amount of oil is to be applied.

Generally for the roller 44 there will be utilized two different roller devices with one being a double drummed steel roller and the other being a pneumatic tire roller. Each of these rollers should be at least twelve tons in weight. The compaction temperature with the rollers 44 shall be at least 220° F.

What is claimed is:

1. The method of resurfacing an asphalt surface comprising the steps of:

heating by convection a portion of the asphalt surface;

scarifying said portion to a preselected depth creating a layer of loose aggregate material on a solid surface;

applying a quantity of oil to said loose aggregate material;

thoroughly mixing said loose aggregate material and said oil utilizing at least two pairs of curved blades with one said pair having a V-shaped section and then supplying said loose aggregate material and said oil to an auger for further mixing and distribution across said solid surface;

screeding said loose aggregate material mixed with said oil forming a level surface; and rolling said level surface achieving compaction plus cementing of said loose aggregate material.

2. The method of resurfacing an asphalt surface comprising the steps of:

heating by convection a portion of the asphalt surface;

scarifying said portion to a preselected depth creating a layer of loose aggregate material;

applying in an evenly distributing manner a quantity of oil that has been heated to approximately 240 degrees Fahrenheit to said loose aggregate material with there being between 0.09 gallons per square yard to 0.12 gallons per square yard of said oil applied to said asphalt surface;

thoroughly mixing said loose aggregate material and said oil;

screeding said loose aggregate material mixed with said oil forming a level surface; and rolling said level surface achieving compaction plus cementing of said loose aggregate material.

3. The method of claim 2 wherein the step of thoroughly mixing includes utilizing at least two pairs of curved blades with one said pair having a V-shaped section and then supplying said loose aggregate material to an auger for further mixing and distribution across the asphalt surface.

4. The method of resurfacing an asphalt surface comprising the steps of:

heating by convection a portion of the asphalt surface;

scarifying said portion to a preselected depth creating a layer of loose aggregate material;

adding additional virgin asphalt to said asphalt surface with the amount of said virgin asphalt being between ten percent and thirty percent by weight of said loose aggregate material;

applying a quantity of oil to said loose aggregate material;

thoroughly mixing the combination of said loose aggregate material and said oil and said additional virgin asphalt;

screeding said combination forming a level surface; and rolling said level surface achieving compaction plus cementing of said loose aggregate material.

5. The method as defined in claim 4 wherein the thoroughly mixing step includes utilizing at least two pairs of curved blades with one said pair having a V-shaped section and then supplying said loose aggregate material to an auger for further mixing and distribution across said asphalt surface.

6. The method as defined in claim 5 wherein the step of applying includes heating of the oil to approximately 240 degrees Fahrenheit and evenly distributing the oil across the loose aggregate material with there being between 0.09 gallons per square yard of said asphalt surface to 0.12 gallons per square yard of said asphalt surface.

* * * * *